US005590950A

United States Patent [19]

Hildebrand

[11] Patent Number: 5,590,950

[45] Date of Patent: Jan. 7, 1997

[54] PORTABLE OBJECT ILLUMINATION DEVICE

[76] Inventor: Eduard Hildebrand, 1274 E. Santa Ana St., Anaheim, Calif. 92805

[21] Appl. No.: 502,814

[22] Filed: Jul. 14, 1995

[51] Int. Cl.[6] ..... F21V 33/00

[52] U.S. Cl. ..... 362/109; 362/191; 362/184

[58] Field of Search ..... 362/191, 109, 362/184, 205, 802, 800, 253, 98

[56] References Cited

U.S. PATENT DOCUMENTS

| | | | |
|---|---|---|---|
| D. 318,337 | 7/1991 | Taylor et al. | D26/38 |
| 4,905,127 | 2/1990 | Kaminski | 362/109 |
| 4,949,230 | 8/1990 | Burmeister | 362/109 |
| 5,136,477 | 8/1992 | Lemmey | 362/109 |
| 5,163,748 | 11/1992 | Messinger | 362/98 |
| 5,183,325 | 2/1993 | Hurdle | 362/109 |
| 5,188,448 | 2/1993 | Siriani et al. | 362/802 |
| 5,203,622 | 4/1993 | Sottile | 362/109 |
| 5,263,209 | 11/1993 | Pattee | 362/101 |
| 5,305,190 | 4/1994 | Clement | 362/83.3 |

*Primary Examiner*—Ira S. Lazarus
*Assistant Examiner*—Sara Sachie Raab

[57] ABSTRACT

A device for illuminating an upper surface of a portable object. The inventive device includes a housing securable to an upper surface of a remote control device. A pair of lighting members project from a front wall of the housing for illuminating the upper surface of the remote control device as desired.

12 Claims, 3 Drawing Sheets

12
30
10
24
26

12
22
18
38
16
10
32
14
20
32
18

FIG 3
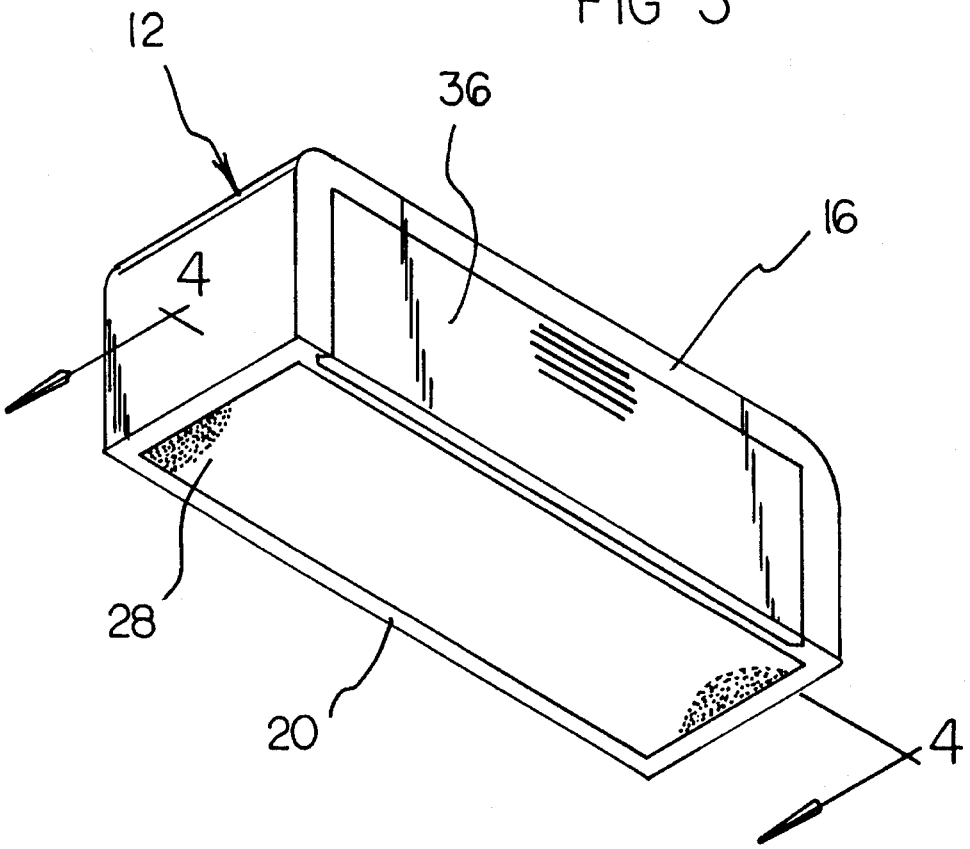
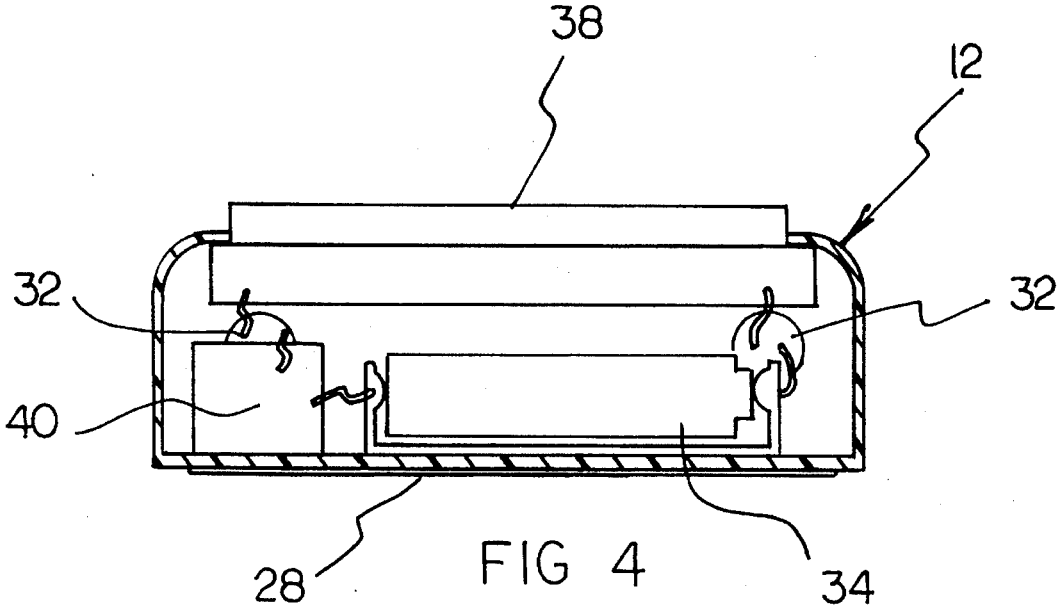
FIG 4

PORTABLE OBJECT ILLUMINATION DEVICE

BACKGROUND OF THE INVENTION

1. Field of the Invention

The present invention relates to illumination structures and more particularly pertains to a portable object illumination device for illuminating an upper surface of a portable object.

2. Description of the Prior Art

The use of illumination structures is known in the prior art. More specifically, illumination structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art illumination structures include U.S. Pat. No. 5,188,448; U.S. Pat. No. 5,203,622; U.S. Pat. No. 5,305,190; U.S. Pat. No. 5,263,209; U.S. Pat. No. 5,163,748; and U.S. Pat. No. Des. 318,337.

While these devices fulfill their respective, particular objectives and requirements, the aforementioned patents do not disclose a portable object illumination device for illuminating an upper surface of a portable object which includes a housing securable to an upper surface of a remote control device, and a pair of lighting members projecting from a front wall of the housing for illuminating the upper surface of the remote control device as desired.

In these respects, the portable object illumination device according to the present invention substantially departs from the conventional concepts and designs of the prior art, and in so doing provides an apparatus primarily developed for the purpose of illuminating an upper surface of a portable object.

SUMMARY OF THE INVENTION

In view of the foregoing disadvantages inherent in the known types of illumination structures now present in the prior art, the present invention provides a new portable object illumination device construction wherein the same can be utilized for illuminating an upper surface of a portable object such as a remote control device. As such, the general purpose of the present invention, which will be described subsequently in greater detail, is to provide a new portable object illumination device apparatus and method which has many of the advantages of the illumination structures mentioned heretofore and many novel features that result in a portable object illumination device which is not anticipated, rendered obvious, suggested, or even implied by any of the prior art illumination structures, either alone or in any combination thereof.

To attain this, the present invention generally comprises a device for illuminating an upper surface of a portable object. The inventive device includes a housing securable to an upper surface of a remote control device. A pair of lighting members project from a front wall of the housing for illuminating the upper surface of the remote control device as desired.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new portable object illumination device apparatus and method which has many of the advantages of the illumination structures mentioned heretofore and many novel features that result in a portable object illumination device which is not anticipated, rendered obvious, suggested, or even implied by any of the prior art illumination structures, either alone or in any combination thereof.

It is another object of the present invention to provide a new portable object illumination device which may be easily and efficiently manufactured and marketed.

It is a further object of the present invention to provide a new portable object illumination device which is of a durable and reliable construction.

An even further object of the present invention is to provide a new portable object illumination device which is susceptible of a low cost of manufacture with regard to both materials and labor, and which accordingly is then susceptible of low prices of sale to the consuming public, thereby making such portable object illumination devices economically available to the buying public.

Still yet another object of the present invention is to provide a new portable object illumination device which provides in the apparatuses and methods of the prior art some of the advantages thereof, while simultaneously overcoming some of the disadvantages normally associated therewith.

Still another object of the present invention is to provide a new portable object illumination device for illuminating an upper surface of a portable object such as a remote control.

Yet another object of the present invention is to provide a new portable object illumination device which includes a housing securable to an upper surface of a remote control device, and a pair of lighting members projecting from a front wall of the housing for illuminating the upper surface of the remote control device as desired.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a rear isometric illustration thereof.

FIG. 4 is a cross-sectional view taken along line 4—4 of FIG. 3.

DESCRIPTION OF THE PREFERRED EMBODIMENT

Figure 1:
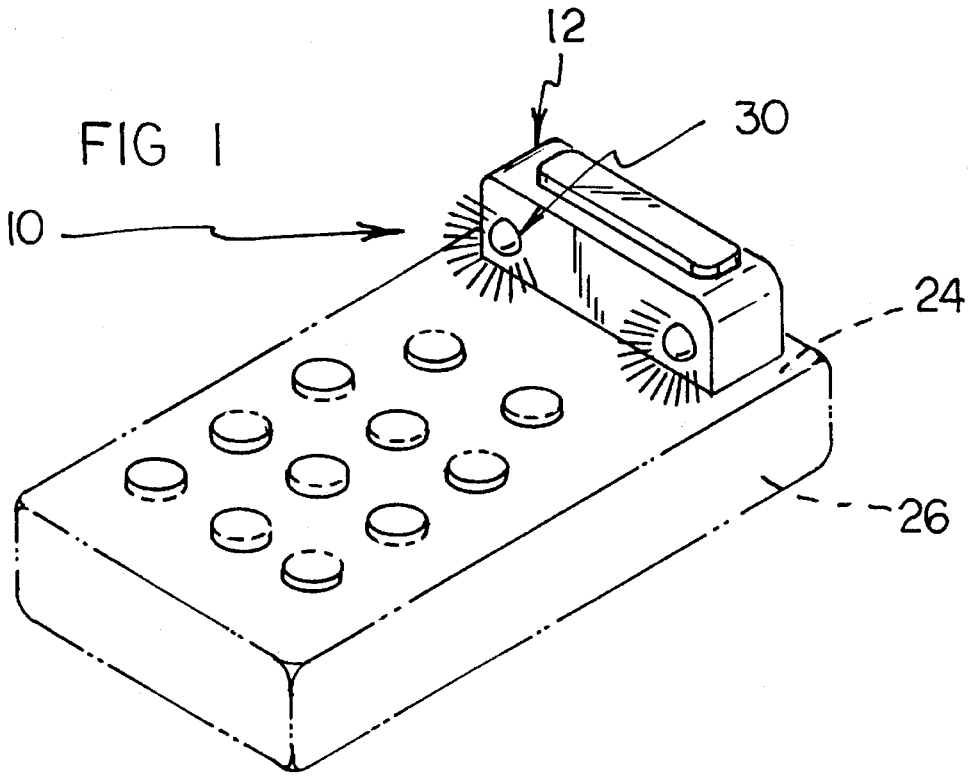
FIG. 1 is an isometric illustration of a portable object illumination device according to the present invention in use.

With reference now to the drawings, and in particular to FIGS. 1–6 thereof, a new portable object illumination device embodying the principles and concepts of the present invention and generally designated by the reference numeral 10 will be described.

More specifically, it will be noted that the portable object illumination device 10 comprises a housing 12 shaped so as to define a front wall 14 spaced from a rear wall 16, with lateral walls 18 extending substantially orthogonally between the front and rear walls. A bottom wall 20 and a top wall 22 extend in a substantially spaced and parallel orientation relative to one another between the front and rear walls 14 and 16, as well as the lateral walls 18 so as to define a substantially rectangular shape of the housing 12. A mounting means is secured to the bottom wall 20 of the housing 12 for facilitating securement of the housing to an upper surface 24 of a portable object 26 such as the remote control device illustrated in FIG. 1. To this end, the mounting means preferably comprises an adhesive 28 in the form of double-stick tape extending along the bottom wall 20 of the housing 12, as shown in FIG. 3 of the drawings.

Figure 2:
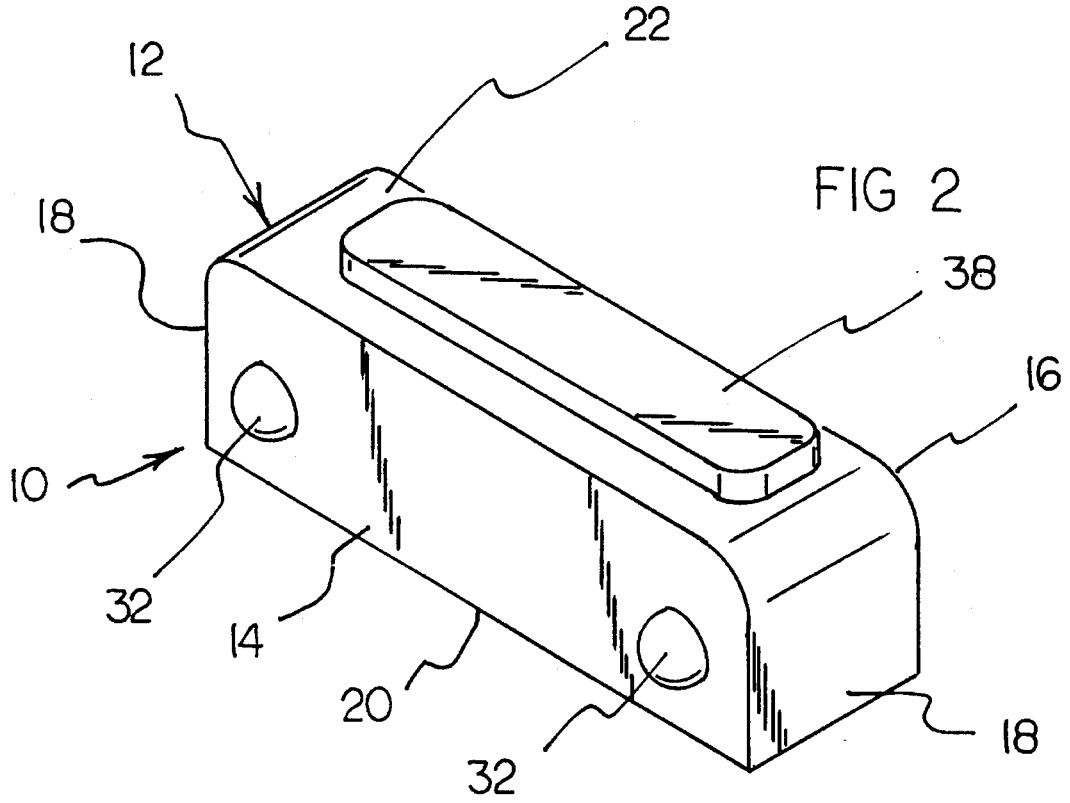
FIG. 2 is an isometric illustration of the invention, per se.

As best illustrated in FIGS. 1, 2, and 4, it can be shown that the present invention 10 further comprises an illumination means 30 for illuminating an area in front of the front wall 14 of the housing 12. To this end, the illumination means 30 according to the present invention 10 preferably comprises a pair of lighting members 32 mounted to the front wall 14 and oriented so as to project substantially orthogonally therefrom. As shown in FIG. 4, the illumination means 30 further comprises a battery 34 removably positioned within the housing 12 through an access cover 36 which covers an aperture directed through the rear wall 16 of the housing 12. The battery 34 is positioned in electrical communication with a switch 38 projecting from the top wall 22 of the housing 12. If desired, a timer 40 can be electrically interposed between the battery 34 and the lighting members 32 such that an activation of the switch 38 will effect energization of the lighting members 32 for a predetermined length of time. Alternatively, the switch 38 may simply comprise a momentary switch, wherein the lighting members 32 are caused to be energized for a period of the equal to a period of time in which the switch 38 is depressed. Further, the switch 38 may comprise a push-on push-off switch, wherein repeated alternating actuations of the switch 38 cause the lighting members 32 to become energized. Preferably, the lighting members 32 comprise LEDs which are directed through apertures in the front wall 14 and secured thereto by suitable adhesive for frictional engagement.

Figure 5:
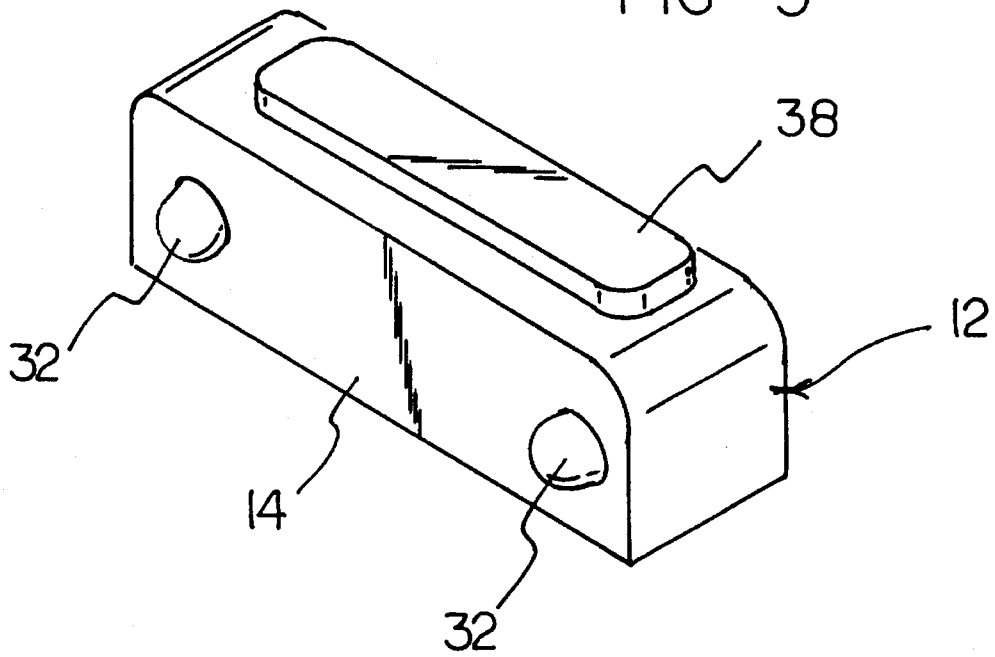
FIG. 5 is an isometric illustration of an alternative form of an illumination means of the present invention.
Figure 6:
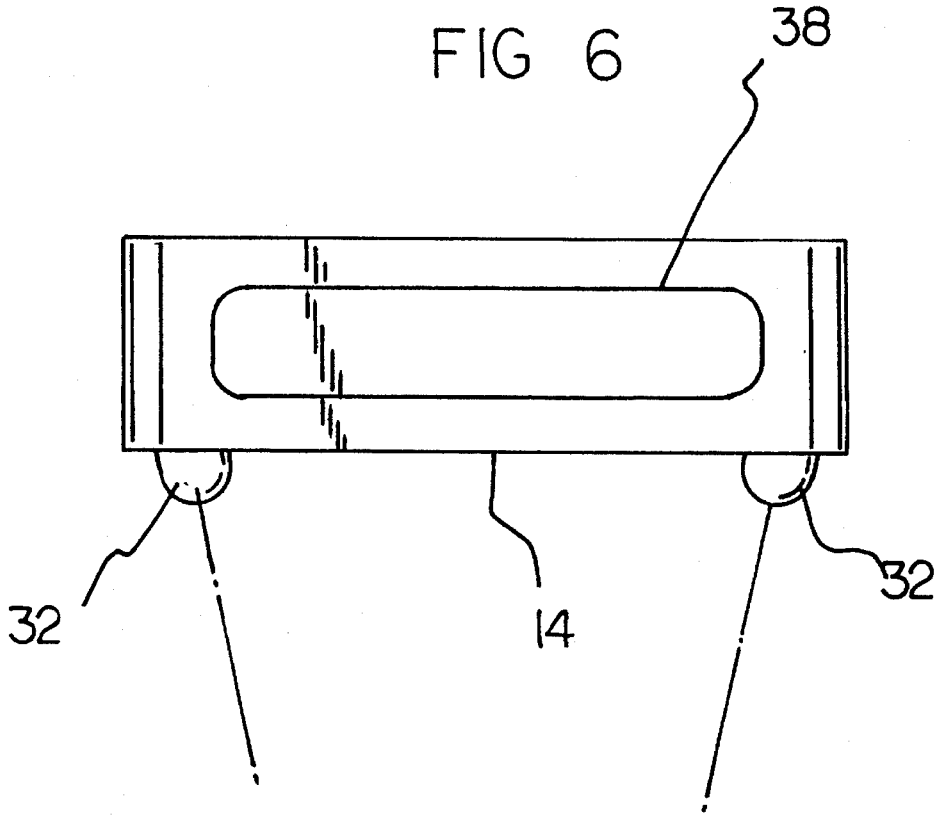
FIG. 6 is a top plan view of the device as illustrated in FIG. 5.

Although the LEDs or lighting members 32 preferably project substantially orthogonally from the front wall 14 of the housing 12, the present invention 10 may be configured as shown in FIGS. 5 and 6 of the drawings such that the lighting members 32 project at an oblique angle from the front wall 14 of the housing 12. As best illustrated in the plan view of FIG. 6, the LEDs or lighting members 32 are angled towards an axis of symmetry directed orthogonally through the front and rear walls 14 and 16 and bisecting the housing 12. By this structure, the lighting members 32 are caused to more brightly illuminate the upper surface 24 of the portable object 26 when attached as shown in FIG. 1 relative to an area or environment surrounding the upper surface.

In use, the portable object illumination device 10 according to the present invention can be easily secured to the upper surface 14 of a portable object 26 such as a remote control device as illustrated in FIG. 1. The switch 38 of the illumination means 30 can be selectively actuated to permit energization of the lighting members for LEDs 32 for a predetermined length of time. If desired, the timer 40 can be eliminated from the electrical circuit of the illumination means 30 such that the lighting members 32 respond directly to an operation of the switch 38. The switch 38, as noted above, may comprise a momentary switch or alternatively an alternating switch wherein repeated alternating actuations of the switch 38 effect energization of the lighting members 32 as desired by an end user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A portable object illumination device comprising:

a housing having a front wall;

a mounting means secured to the housing for facilitating securement of the housing to an upper surface of a portable object;

an illumination means disposed within the front wall of the housing for illuminating the area in front of the front wall of the housing, the illumination means comprises a pair of lighting members mounted to the front wall and oriented so as to project substantially orthogonally therefrom; a switch projecting from the top wall of the housing and electrically coupled to the lighting members, the switch being electrically couplable to a battery; and a timer electrically interposed between the switch and the lighting members such that an activation of the switch will effect energization of the lighting members for a predetermined length of time.

2. A portable object illumination device comprising:

a housing having a front wall;

a mounting means secured to the housing for facilitating securement of the housing to an upper surface of a portable object;

an illumination means disposed Within the front wall the housing for illuminating the area in front of the front wall of the housing, the illumination means comprises a pair of lighting members mounted to the front wall and oriented so as to project substantially orthogonally therefrom; a switch projecting from the top wall of the housing and electrically coupled to the lighting members, the switch being electrically couplable to a battery; wherein the switch comprises a momentary switch such that the lighting members can be caused to be energized for a period of time equal to a period of time in which the switch is depressed.

3. A portable object illumination device comprising:

a housing having a front wall;

a mounting means secured to the housing for facilitating securement of the housing to an upper surface of a portable object;

an illumination means disposed within the front wall of the housing for illuminating the area in front of the front wall of the housing, the illumination means comprises a pair of lighting members mounted to the front wall and oriented so as to project substantially orthogonally therefrom; a switch projecting from the top wall of the housing and electrically coupled to the lighting members, the switch being electrically couplable to a battery; wherein the switch comprises a push-on push-off switch such that repeated alternating actuations of the switch can cause the lighting members to become energized.

4. A portable object illumination device comprising:

a housing having a front wall;

a mounting means secured to the housing for facilitating securement of the housing to an upper surface of a portable object;

an illumination means disposed within the front wall of the housing for illuminating the area in front of the front wall of the housing, the illumination means comprises a pair of lighting members mounted to the front wall at an oblique angle relative thereto and towards an axis of symmetry directed orthogonally through the front and rear walls and bisecting the housing; a switch projecting from the top wall of the housing and electrically coupled to the lighting members, the switch being electrically couplable to a battery; and a timer electrically interposed between the switch and the lighting members such that an activation of the switch will effect energization of the lighting members for a predetermined length of time.

5. A portable object illumination device comprising:

a housing having a front wall;

a mounting means secured to the housing for facilitating securement of the housing to an upper surface of a portable object;

an illumination means disposed within the front wall of the housing for illuminating the area front of the front wall of the housing, the illumination means comprises a pair of lighting members mounted to the front wall at an oblique angle relative thereto and towards an axis of symmetry directed orthogonally through the front and rear walls and bisecting the housing; a switch projecting from the top wall of the housing and electrically coupled to the lighting members, the switch being electrically couplable to a battery; wherein the switch comprises a momentary switch such that the lighting members can be caused to be energized for a period of time equal to a period of time in which the switch is depressed.

6. A portable object illumination device comprising:

a housing having a front wall;

a mounting means secured to the housing for facilitating securement of the housing to an upper surface of a portable object;

an illumination means disposed within the front wall of the housing for illuminating the area in front of the front wall of the housing, the illumination means comprises a pair of lighting members mounted to the front wall at an oblique angle relative thereto and towards an axis of symmetry directed orthogonally through the front and rear walls and bisecting the housing; a switch projecting from the top wall of the housing and electrically coupled to the lighting members, the switch being electrically couplable to a battery; wherein the switch comprises a push-on push-off switch such that repeated alternating actuations of the switch can cause the lighting members to become energized.

7. A portable object illumination device comprising:

a housing having a front wall, the housing being shaped so as to define a rear wall spaced from the front wall, lateral walls extending between the front and rear walls, and spaced top and bottom walls extending between the front and rear walls and the lateral walls so as to define a substantially rectangular shape of the housing;

an illumination means disposed within the front wall of the housing for illuminating an area in front of the front wall; the illumination means comprises a pair of lighting members mounted to the front wall and oriented so as to project substantially orthogonally therefrom; a switch projecting from the top wall of the housing and electrically coupled to the lighting members, the switch being electrically couplable to a battery; and a timer electrically interposed between the switch and the lighting members such that an activation of the switch will effect energization of the lighting members for a predetermined length of time.

8. A portable object illumination device comprising:

a housing having a front wall, the housing being shaped so as to define a rear wall spaced from the front wall, lateral walls extending between the front and rear walls, and spaced top and bottom walls extending between the front and rear walls and the lateral walls so as to define a substantially rectangular shape of the housing;

an illumination means disposed within the front wall of the housing for illuminating an area in front of the front wall; the illumination means comprises a pair of lighting members mounted to the front wall and oriented so as to project substantially orthogonally therefrom; a switch projecting from the top wall of the housing and electrically coupled to the lighting members, the switch being electrically couplable to a battery; wherein the switch comprises a momentary switch such that the lighting members can be caused to be energized for a period of time equal to a period of time in which the switch is depressed.

9. A portable object illumination device comprising:

a housing having a front wall, the housing being shaped so as to define a rear wall spaced from the front wall, lateral walls extending between the front and rear walls, and spaced top and bottom walls extending between the front and rear walls and the lateral walls so as to define a substantially rectangular shape of the housing;

an illumination means disposed within the front wall of the housing for illuminating an area in front of the front wall; the illumination means comprises a pair of lighting members mounted to the front wall and oriented so as to project substantially orthogonally therefrom; a switch projecting from the top wall of the housing and electrically coupled to the lighting members, the switch being electrically couplable to a battery; wherein the switch comprises a push-on push-off switch such that repeated alternating actuations of the switch can cause the lighting members to become energized.

10. A portable object illumination device comprising:

a housing having front wall, the housing being shaped so as to define a rear wall spaced from the front wall, lateral walls extending between the front and rear walls, and spaced top and bottom walls extending between the front and rear walls and the lateral walls so as to define a substantially rectangular shape of the housing;

an illumination means disposed within the front wall of the housing for illuminating an area in front of the front wall; the illumination means comprises a pair of lighting members mounted to the front wall at an oblique angle relative thereto and towards an axis of symmetry directed orthogonally through the front and rear walls and bisecting the housing; a switch projecting from the top wall of the housing and electrically coupled to the lighting members, the switch being electrically couplable to a battery; and a timer electrically interposed between the switch and the lighting members such that an activation of the switch will effect energization of the lighting members for a predetermined length of time.

11. A portable object illumination device comprising:

a housing having a front wall, the housing being shaped so as to define a rear wall spaced from the front wall, lateral walls extending between the front and rear walls, and spaced top and bottom walls extending between the front and rear walls and the lateral walls so as to define a substantially rectangular shape of the housing;

an illumination means disposed within the front wall of the housing for illuminating an area in front of the front wall; the illumination means comprises a pair of lighting members mounted to the front wall at an oblique angle relative thereto and towards an axis of symmetry directed orthogonally through the front and rear walls and bisecting the housing; a switch projecting from the top wall of the housing and electrically coupled to the lighting members, the switch being electrically couplable to a battery; wherein the switch comprises a momentary switch such that the lighting members can be caused to be energized for a period of time equal to a period of time in which the switch is depressed.

12. A portable object illumination device comprising:

a housing having a front wall, the housing being shaped so as to define a rear wall spaced from the front wall, lateral walls extending between the front and rear walls, and spaced top and bottom walls extending between the front and rear walls and the lateral walls so as to define a substantially rectangular shape of the housing;

an illumination means disposed within the front wall of the housing for illuminating an area in front of the front wall; the illumination means comprises a pair of lighting members mounted to the front wall at an oblique angle relative thereto and towards an axis of symmetry directed orthogonally through the front and rear walls and bisecting the housing; a switch projecting from the top wall of the housing and electrically coupled to the lighting members, the switch being electrically couplable to a battery; wherein the switch comprises a push-on push-off switch such that repeated alternating actuations of the switch can cause the lighting members to become energized.

* * * * *